US009938806B2

(12) United States Patent
Kirk et al.

(10) Patent No.: US 9,938,806 B2
(45) Date of Patent: Apr. 10, 2018

(54) CHARGE PUMP FOR GRAVITY GAS SEPARATOR OF WELL PUMP

(71) Applicant: Baker Hughes Incorporated, Houston, TX (US)

(72) Inventors: Jordan D. Kirk, Broken Arrow, OK (US); Leslie C. Reid, Coweta, OK (US); Brown Lyle Wilson, Tulsa, OK (US)

(73) Assignee: Baker Hughes, A GE Company, LLC, Houston, TX (US)

( * ) Notice: Subject to any disclaimer, the term of this patent is extended or adjusted under 35 U.S.C. 154(b) by 283 days.

(21) Appl. No.: 14/984,623

(22) Filed: Dec. 30, 2015

(65) Prior Publication Data

US 2016/0222770 A1 Aug. 4, 2016

Related U.S. Application Data

(60) Provisional application No. 62/109,953, filed on Jan. 30, 2015.

(51) Int. Cl.

| | |
|---|---|
| ***E21B 43/38*** | (2006.01) |
| ***E21B 43/12*** | (2006.01) |
| ***E21B 33/12*** | (2006.01) |

(52) U.S. Cl.

CPC ..... *E21B 43/128* (2013.01); *E21B 33/12* (2013.01); *E21B 43/38* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,932,160 | B2 | 8/2005 | Murray | |
| 8,141,625 | B2 | 3/2012 | Reid | |
| 2005/0217860 | A1* | 10/2005 | Mack | E21B 33/1275 166/369 |
| 2010/0319926 | A1* | 12/2010 | Reid | E21B 43/128 166/372 |

OTHER PUBLICATIONS

U.S. Appl. No. 14/537,381, filed Nov. 10, 2014, Inventors: Brown Lyle Wilson and Donn J. Brown, entitled; "Coaxial Gas Riser for Submersible Well Pump".

* cited by examiner

*Primary Examiner* — Kyle Armstrong

(74) *Attorney, Agent, or Firm* — Bracewell LLP; James E. Bradley

(57) ABSTRACT

A well pump assembly has a main pump suspended on a string of production tubing within casing in a well. A charge pump is located below the main pump. An annular sealing element between the charge pump intake and the charge pump discharge seals between the charge pump and the casing. A motor is coupled with the main pump and the charge pump. A bypass member has an open upper end above the main pump intake and a lower end above the sealing element. The bypass member defines a flow path from the discharge of the charge pump upward past the main pump intake, then downward to reach the main pump intake. The bypass member may be a bypass riser extending alongside the main pump, or it may be a shroud surrounding the main pump.

8 Claims, 3 Drawing Sheets

CHARGE PUMP FOR GRAVITY GAS SEPARATOR OF WELL PUMP

FIELD OF THE DISCLOSURE

This disclosure relates in general to hydrocarbon well pumps and in particular to an assembly that includes a charging pump to deliver well fluid to a gravity gas separator prior to the well fluid reaching an intake of the main lift pump.

BACKGROUND

Electrical submersible pumps (ESP) are often employed to pump well fluid from wells. A typical ESP includes a rotary pump driven by an electrical motor. Normally, the ESP is suspended in the well on a string of production tubing. A seal section, usually located between the motor and the pump, has a movable element to reduce a pressure differential between the well fluid exterior of the motor and motor lubricant contained in the motor. The pump may be a centrifugal pump having a plurality of stages, each stage having an impeller and a diffuser.

Some wells produce gas along with liquid, and centrifugal pumps operate best when pumping primarily liquid. Gas separators of various types may be employed to separate the gas from the liquid prior to reaching the pump. However, some gas may still reach the pump, particularly when the well fluid contains slugs or large bubbles of gas.

Shrouds may be employed in various ways to cause gas separation before reaching the pump intake. In one design, the shroud surrounds the pump and has an inlet at an upper end. Well fluid flows upward around the shroud, then downward into the inlet and to the pump intake. As the well fluid turns to flow downward, gas in the well fluid tends to continue flowing upward while the heavier liquid portions flow downward into the shroud inlet.

U.S. Pat. No. 6,932,160 discloses a system using a bypass riser offset from a longitudinal axis of the ESP. The riser has an inlet extending through a barrier in the well below the pump intake. The riser has an outlet above the pump intake. As well fluid discharges from the bypass tube outlet, the gas portions tend to continue flowing upward while the liquid portions flow downward to the pump intake. The bypass tube may have helical vanes within to enhance separation of the gas and liquid portions.

SUMMARY

A well pump assembly comprises a main pump adapted to be suspended on a string of production tubing within casing in a well. The main pump has a main pump intake and a main pump discharge for discharging into the production tubing. A charge pump is operatively connected with and below the main pump. The charge pump has a charge pump intake and a charge pump discharge. An annular sealing element between the charge pump intake and the charge pump discharge has an inner diameter in sealing engagement with the charge pump and an outer diameter for sealing engagement with the casing to direct well fluid flowing up from below the sealing element into the charge pump intake. A motor operatively coupled with the main pump and the charge pump drives the main pump and the charge pump. A bypass member has an open upper end above the main pump intake and a lower end above the sealing element, The bypass member defines a flow path from the discharge of the charge pump upward past the main pump intake, then downward to reach the main pump intake, thereby causing a gravity separation of liquid from gas in the well fluid.

In some of the embodiments, the bypass member comprises a bypass riser extending alongside and parallel to the main pump. The bypass riser has a lower end coupled to the charge pump discharge. The flow path directs all of the well fluid discharged by the charge pump into the lower end of the bypass riser and out an upper end of the bypass riser.

In some of the embodiments, the motor is located between the charge pump and the main pump. The bypass riser extends alongside the motor. In other embodiments, the motor is suspended below the charge pump.

The main pump and the charge pump are preferably centrifugal pumps having a plurality of stages. The charge pump has fewer stages than the main pump.

In some of the embodiments, the bypass member comprises a shroud surrounding the main pump and having a dosed lower end sealed to the assembly below the main pump intake and above the charge pump discharge. The flow path directs all of the well fluid discharged by the charge pump directly into the casing, then up a shroud annulus on the exterior of the shroud, then down the shroud to the main pump intake.

In some of the embodiments, the motor is located above the charge pump and below the closed lower end of the shroud. In other embodiments, the motor is located below the charge pump and the sealing element.

An electrical power cord extending alongside the main pump within the shroud. The power cord extends sealingly through an aperture in the closed lower end of the shroud and down to the motor.

A lower assembly annulus surrounds a lower portion of the assembly from the sealing element to the closed lower end of the shroud. The lower assembly annulus extends radially to the casing.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1A:
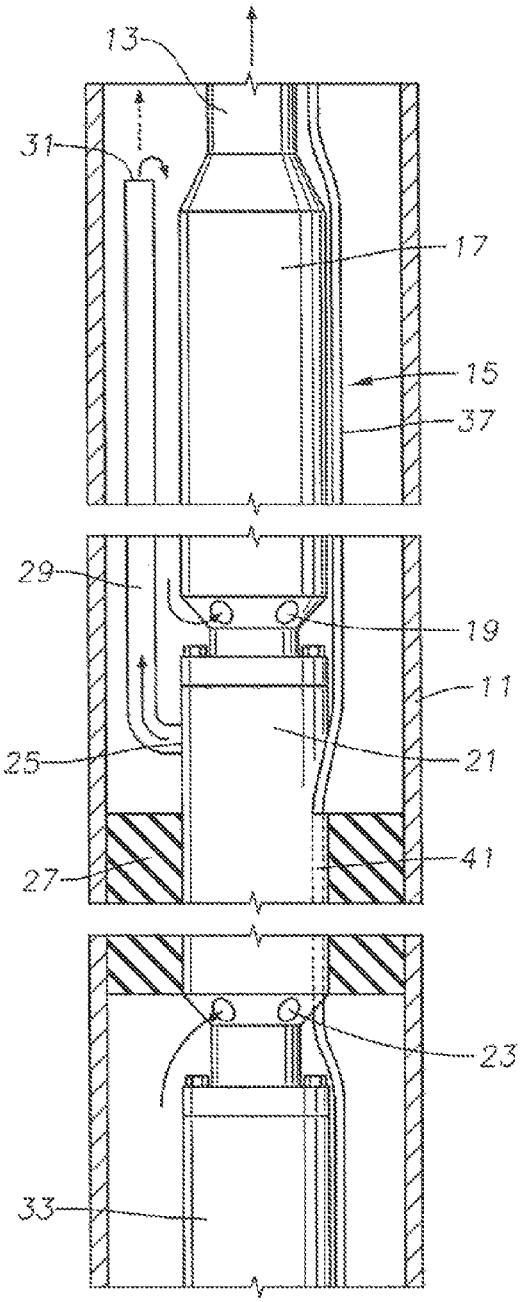
FIGS. 1A and 1B comprise as schematic side view of a first embodiment of a pump assembly in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1A, the well has casing 11 cemented within. Casing 11 has perforations (not shown) or other openings to admit well fluid. A string of production tubing 13 extends downward from a wellhead assembly (not shown) at the upper end of the well. Production tubing 13 supports an electrical submersible pump assembly (ESP) 15.

ESP 15 includes a main pump 17, which may be a conventional centrifugal pump having a large number of stages, each stage having an impeller and a diffuser. Main pump 17 has a main pump intake 19 at its lower end and a discharge at its upper end that discharges into production tubing 13. A conventional rotary gas separator (not shown) optionally may be coupled to the lower end of main pump 17. In that event, main pump intake 19 would be at the lower end of the gas separator.

ESP 15 includes a separate charge pump 21 located below main pump 17. Charge pump 21 is preferably a centrifugal pump, also, except that it has only a few stages, such as three or four, much less than main pump 17. In FIG. 1A, charge pump 21 secures directly to main pump intake 19 either by bolted flanges, as shown, or by a rotatable threaded collar. Alternately, charge pump 21 could be built into main pump 17, on the same shaft and within the same housing. Further, charge pump 21 could be independent and completely separate from main pump 17. Charge pump 21 has a charge pump intake 23 and a charge pump discharge 25.

A resilient sealing element such as a packer 27, is located between charge pump intake 23 and charge pump discharge 25. Packer 27 has an inner diameter in sealing engagement with the exterior of charge pump 21 and an outer diameter in sealing engagement with casing 11. Packer 27 seals between the outer surface of charge pump 21 and casing 11, requiring all upward flowing well fluid to flow into charge pump intake 23.

In this example, packer 27 is run into the well as part of ESP assembly 15, rather than a packer installed in advance. However, a previously installed packer could be employed. Packer 27 may have an initial outer diameter smaller than the inner diameter of casing 11. After reaching the desired location, packer 27 is expanded into sealing engagement with casing 11. The expansion could be caused in various ways, such as by pumping a fluid down that causes swelling of packer 27. Alternately, packer 27 could comprise a cup-shaped seal that slides against casing 11 while ESP 15 is lowered into the well. Packer 27 does not need to support the weight of any of the components of ESP 15, as the weight is supported by production tubing 13. As another alternate, packer 27 could be completely separate from charge pump 21.

A bypass member forces well fluid discharged by charge pump 21 to flow upward past main pump intake 19, then turn downward before reaching main pump intake 19. The downward turn causes a gravity separation between gas and liquid in the well fluid. In FIG. 1A, the bypass member comprises is bypass tube or riser 29 that has a lower end coupled to charge pump discharge 25 for receiving all of the well fluid being discharged by charge pump 21. The upper end of bypass riser 29 is located above main pump intake 19, and it could be a considerable distance above the upper end of main pump 17. Bypass riser 29 is offset and parallel with the axis of ESP 15. Bypass riser 29 may be clamped to main pump 17 and may be in side-by-side contact with pump 17. Bypass riser 29 preferably has a non circular cross section, which may be generally crescent shaped, to provide a larger flow area than if the cross section is circular.

In FIG. 1A, a pressure equalizer or seal section 33 connects to the lower end of charge pump 21. A motor 35 secures to the lower end of seal section 33 by bolted flanges, as shown, or a rotatable, threaded collar. Motor 35 is preferably a three-phase electrical motor filled with a dielectric lubricant. Seal section 33 has an element, such as a bag or bellows, that reduces a pressure difference between the dielectric lubricant and the pressure of the well fluid on the exterior of motor 35. Motor 35 rotates a shaft (not shown) that extends in sections through seal section 33, charge pump 21 and into main pump 17 to rotate the impellers in charge pump 21 and main pump 17. Optionally, seal section 33 could be mounted to the lower end of motor 35.

A power cable (not shown) extends downward from the wellhead assembly and has a motor lead 37 on its lower end. Motor lead 37 is on electrical power cord that is preferably flat in cross section and extends alongside roam pump 17, terminating in an electrical connector 39 that plugs into a receptacle near the upper end of motor 35. Motor lead 37 may extend through a passage 41 formed in the sidewall of charge pump 21 or a sleeve surrounding charge pump 21. The portion of motor lead 39 extending through motor lead passage 41 is sealed in motor lead passage 41 and located radially inward from the portion of packer 27 that expands.

Figure 1B:
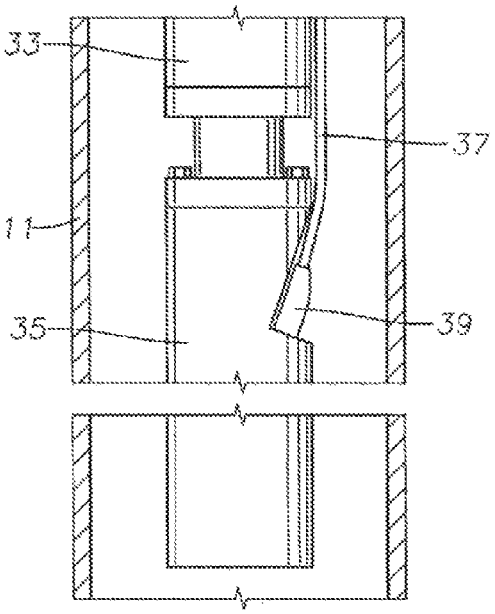

In operation of the embodiment of FIGS. 1A and 1B, power supplied through the power cable and motor lead 37 causes motor 35 to drive charge pump 21 and main pump 17. Charge pump 21 draws well fluid from below packer 27 and discharges all the well fluid into bypass riser 29. The well fluid typically contains gas and liquid, including oil and water. As the well fluid discharges from bypass riser open end 31, the heavier constituents turn and flow downward to main pump intake 19, as indicated by the solid arrows. The turn in direction releases a significant portion of the gas from the well fluid, as indicated by the dotted lines. The released gas flows up the annulus surrounding production tubing 13 to the surface. Main pump 17 discharges the heavier portions of the well fluid into the production tubing 13. The flow path from charge pump 21 is up through bypass riser 29, then down to main pump intake 19.

Figure 2:
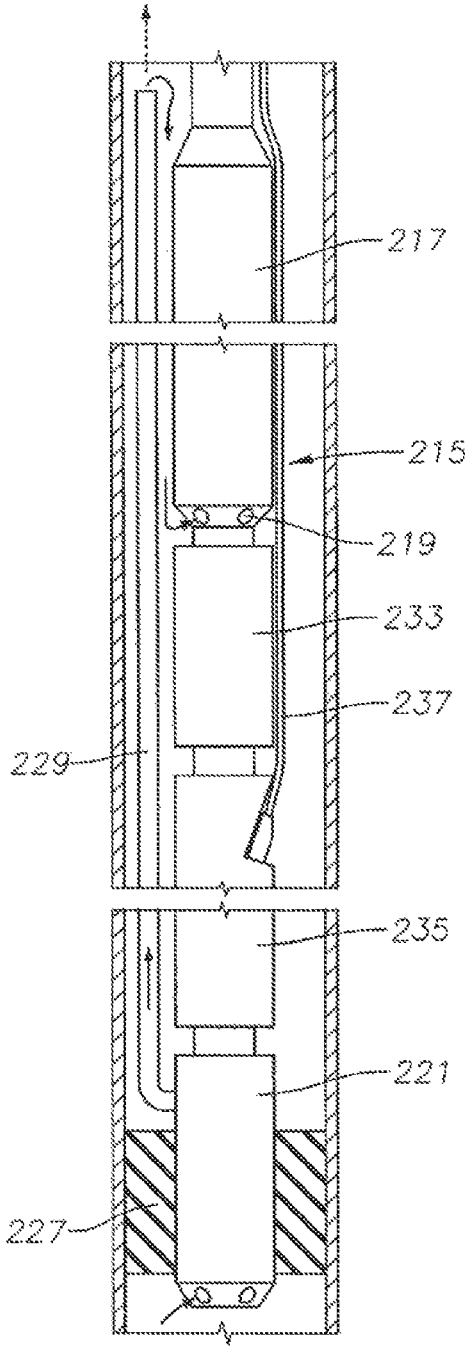
FIG. 2 is a schematic side view of a second embodiment of a pump assembly in accordance with this disclosure.

Referring to FIG. 2, in this embodiment, seal section 233 and motor 235 are moved to a location above packer 227. Seal section 233 connects on its upper end to main pump intake 219. A rotary gas separator could optionally be mounted between seal section 233 and main pump 217, with main pump intake 219 in the rotary gas separator. The upper end of charge pump 221 connects to the lower end of motor 235. The shaft (not shown) of motor 235 has a lower end that couples to the shaft in charge pump 221 to rotate the impellers of charge pump 221. The upper end of the shaft of motor 235 drives main pump 217 in the same manner as in FIG. 1. Bypass riser 229 extends alongside motor 235, seal section 233 and main pump 217. Motor lead 237 extends to motor 235 and does not pass below packer 227. The various components of ESP 215 operate in the same manner as in FIG. 1.

Figure 3:
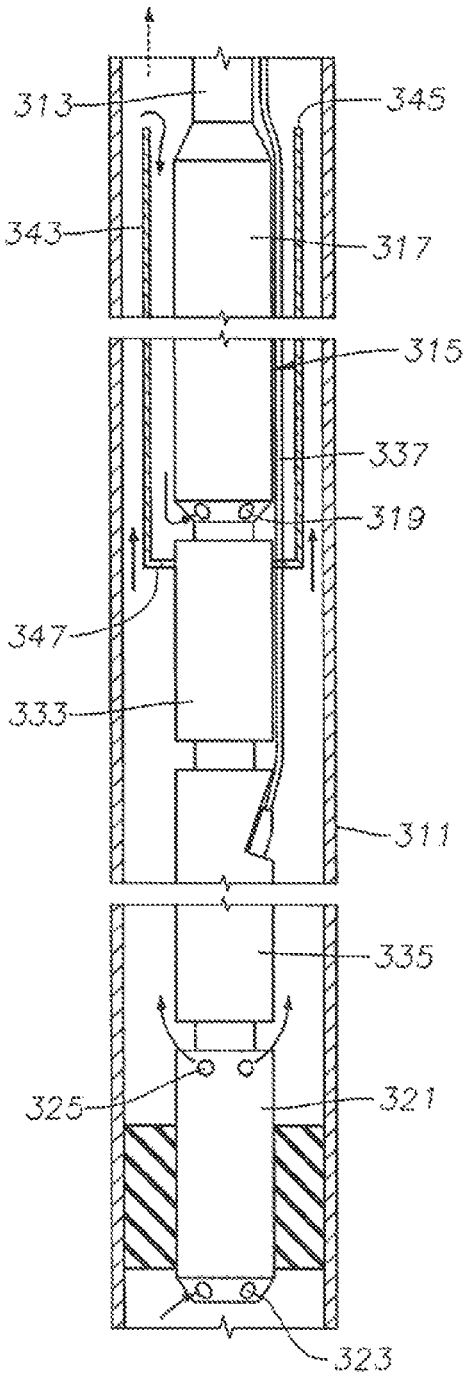
FIG. 3 is a schematic side view of a third embodiment of a pump assembly in accordance with this disclosure.

In the embodiment of FIG. 3, a bypass riser, such as bypass riser 229 (FIG. 2), is not used. Instead, the gravity gas separator or bypass member comprises an inverted shroud 343, which is a sleeve or cylinder surrounding main pump 317. Shroud 343 is concentric with the axis of ESP 315 and has an outer diameter smaller than an inner diameter of casing 311, defining a shroud annulus between shroud 343 and casing 311. Shroud 343 has an open upper end 345, which may comprise holes in the side wall of shroud 343 near the upper end. Shroud 343 has a closed lower end 347 that secures sealingly to ESP 315 below main pump intake 319 and above charge pump discharge 325 of charge pump 321. In this example, closed lower end 347 is shown mounted to an upper end portion of seal section 333. Motor lead 337 extends down shroud 343 and sealingly through an aperture in closed end 347.

A lower assembly annulus surrounds a lower portion of ESP 315 below shroud closed lower end 347 and above packer that seals charge pump 321 to casing 311. The lower assembly annulus extends radially to casing 311.

In the operation of the embodiment of FIG. 3, motor 335 drives both charge pump 321 and main pump 317. Well fluid discharges out charge pump discharge 325 into the lower assembly annulus surrounding motor 335. The well fluid flows up into and through the shroud annulus surrounding inverted shroud 343. The heavier components of the well fluid flow into open end 345 and down inverted shroud 343 to main pump intake 319. The lighter components continue flowing upward, as indicated by the dotted lines. Main pump 317 discharges the heavier components into production tubing 313. The flow path in FIG. 3 is from charge pump discharge 325 into the lower assembly annulus, up past shroud closed end 347 into and through the shroud annulus, then down shroud open upper end 345.

Figure 4:
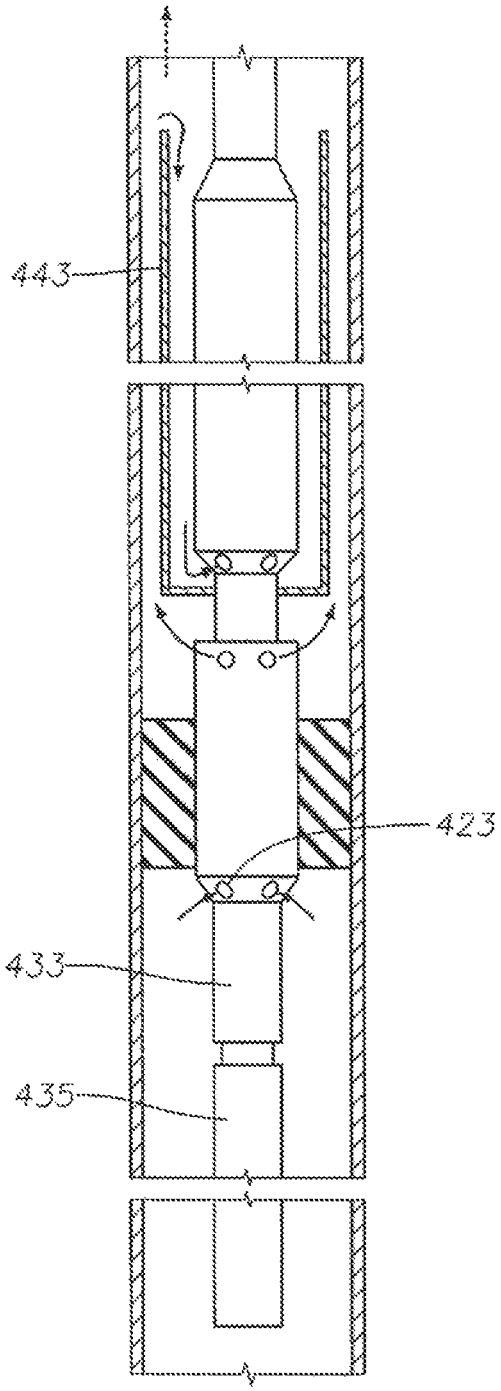
FIG. 4 is a schematic side view of is fourth embodiment of a pump assembly in accordance with this disclosure.

The embodiment of FIG. 4 is similar to the embodiment of FIG. 3, except seal section 433 and motor 435 are suspended below charge pump intake 423. Inverted shroud 443 operates in the same manner as inverted shroud 343 of FIG. 3.

While the disclosure has been shown only a few of its forms, it should be apparent to those skilled in the art that various modifications may be made.

The invention claimed is:

1. A well pump assembly, comprising:

a main pump adapted to be suspended on a siting of production tubing within casing in a well, the main pump having a main pump intake and a main pump discharge for discharging into the production tubing;

a charge pump operatively connected with and below the main pimp, the charge pump having a charge pump intake and a charge pump discharge;

an annular sealing element between the charge pump intake and the charge pump discharge, the sealing dement having an inner diameter in sealing engagement with the charge pump and an outer diameter for sealing engagement with the casing to direct well fluid flowing up from below the sealing element into the charge pump intake;

a motor operatively coupled with the main pump and the charge pump for driving the main pump and the charge pump;

a bypass member having an open upper end above the main pump intake and a lower end above the sealing element;

the bypass member defining a flow path from the discharge of the charge pump upward past the main pump intake, then downward to reach the main pump intake, thereby causing a gravity separation of liquid from gas in the well fluid; and the bypass member comprises a bypass riser extending parallel and eccentric to the main pump, the bypass riser having-a lower end coupled to the charge pump discharge, the flow path directing all of the well fluid discharged by the charge pump into the lower end of the bypass riser and out an upper end of the bypass riser.

2. The assembly according to claim 1, wherein the motor is located between the charge pump and the main pump, and the bypass riser extends alongside the motor.

3. The assembly according to claim 1, wherein the motor is suspended below the charge pump.

4. The assembly according to claim 1, wherein the main pump and the charge pump are centrifugal pumps having a plurality of stages, and the charge pump has fewer stages than the main pump.

5. A well pump assembly, comprising:

a main pump adapted to be suspended on a string of production tubing within casing in a well, the main pump having a main pump intake and a main pump discharge for discharging into the production tubing;

a charge pump operatively connected with and below the main pump, the charge pump having a charge pump intake and a charge pump discharge;

an annular sealing element between the charge pump intake and the charge pump discharge, the sealing element having an inner diameter in sealing engagement with the charge pump and an outer diameter for sealing engagement with the casing to direct well fluid flowing up from below the sealing element into the charge pump intake;

a motor operatively coupled with the main pump and the charge pump for driving the main pump and the charge pump; and a bypass riser having a lower end directly connected to the charge pump discharge for receiving all of the well fluid being pumped by the charge pump, the bypass riser extending parallel and eccentric with the pump and having an open upper end above the main pump intake.

6. The assembly according to claim 5, wherein the motor is suspended below the sealing element and the charge pump.

7. The assembly according to claim 5, wherein;

the motor is suspended below the sealing element and the charge pump, and the assembly further comprises:

a motor lead passage formed in a side wall of the charge pump and extending from above the sealing element to below the sealing element; and an electrical power cord extending alongside the pump, sealingly through the motor lead passage and to the motor to supply electrical power to the motor.

8. The assembly according to claim 5, wherein:

the main pump and the charge pump each having a plurality of centrifugal pump stages; and the charge pump has fewer centrifugal pump stages than the main pump.

* * * * *